United States Patent [19]

Lin

[11] 4,307,458

[45] Dec. 22, 1981

[54] WATCH FOR DISPLAYING MULTIPLE WORLD TIMES

[76] Inventor: A. Oscar Lin, 42-06 66th St., Woodside, N.Y. 11377

[21] Appl. No.: 959,670

[22] Filed: Nov. 13, 1978

[51] Int. Cl.[3] ..... G04B 19/22; G09F 11/12

[52] U.S. Cl. ..... 368/25; 368/26; 40/472

[58] Field of Search ..... 58/4 A, 4 R, 6 R, 42.5–44, 58/125 C, 126 E, 149; 235/1 C; 368/21, 25, 26, 78, 222, 235; 310/23, 24; 40/470–472, 518, 524

[56] References Cited

U.S. PATENT DOCUMENTS 2,072,457 3/1937 Larrabee ..... 58/125 C
2,109,535 3/1938 Jones ..... 58/149 X
2,417,695 3/1947 Lewis ..... 58/42.5
3,232,038 2/1966 Smith ..... 58/42.5

*Primary Examiner*—Vit W. Miska
*Attorney, Agent, or Firm*—Robert T. Tobin

[57] ABSTRACT

The watch has a component in which a plurality of different times corresponding to different world time zones are displayed simultaneously. In one embodiment, the times are designated on an endless belt which is moved in increments under a window. In another embodiment, the times are designated on a roller which is rotated in increments under a window. Incremental motion can take place manually or automatically. In another embodiment, the timepiece component is interconnected into a circuit of a quartz watch.

7 Claims, 18 Drawing Figures

SJUN LENIN TOKYO
CRW MOSCW SEOUL
MAN ABABA OSAKA
L.PIJ NAIRO HIROS
STIJ PEKING FARBK
PAM H.K. ANCOR
TAIPE HONOL
MANIL
7PM
10PM
11PM
6AM
NOON
MDT
3AM
4AM
11AM
5PM
60
27
31
53
26
43
59
6
7
8

34
37
38
24
51
23
29
32
28
31
36
33
30
58
52
53
59
7PM
10PM
11PM
5AM
6AM
7AM
8AM
9AM
10AM
11AM
NOON
1PM
2PM
3PM
4PM
5PM
6PM
7PM
8PM
9PM
10PM
11PM
MDNT

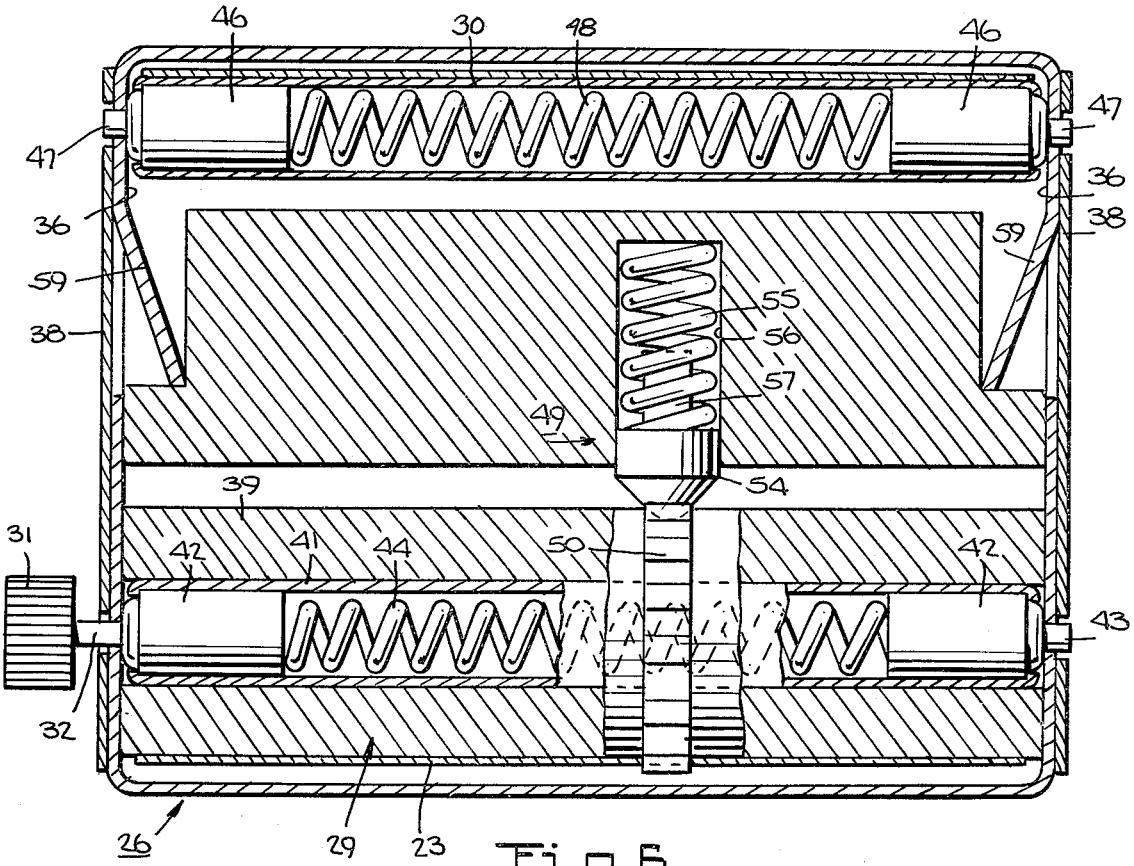
Fig. 6.
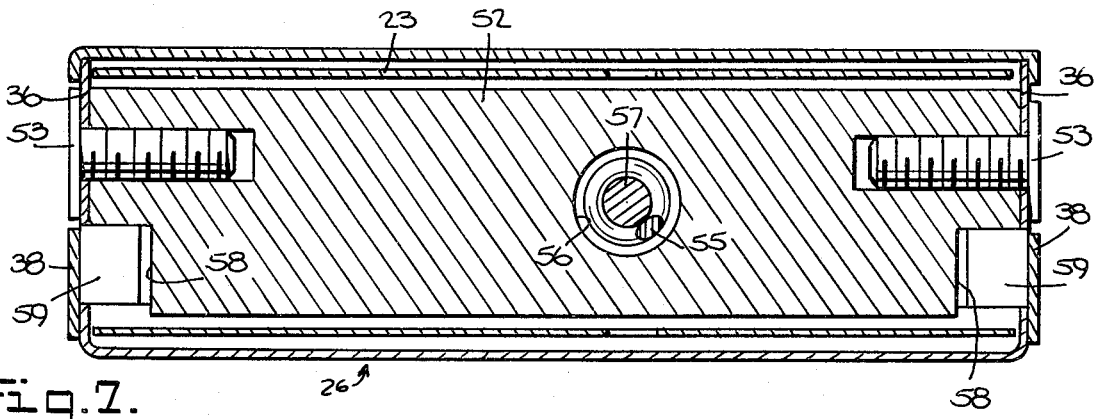
Fig. 7.
Fig. 8.
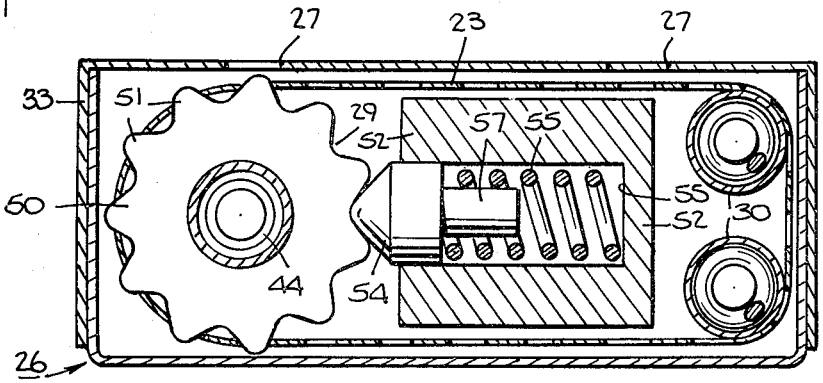

Fig 18
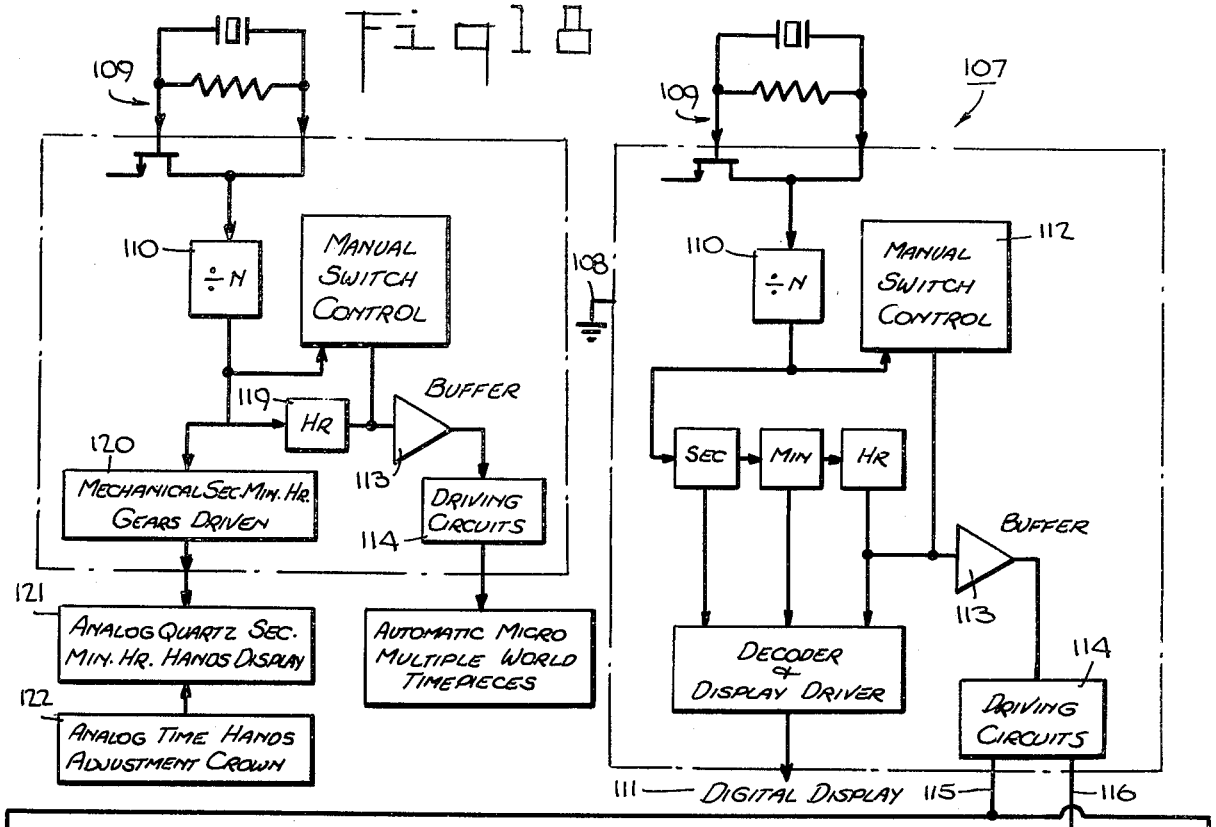
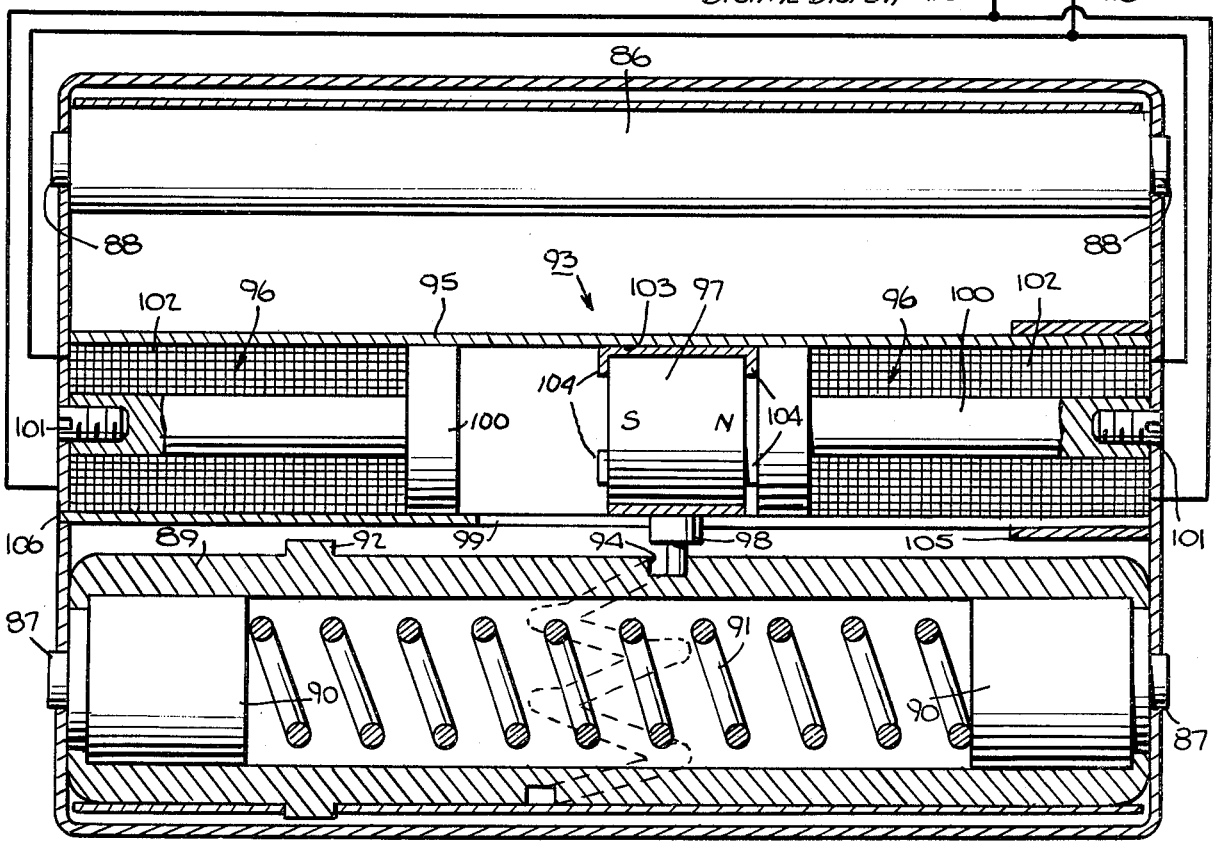
Fig.15.

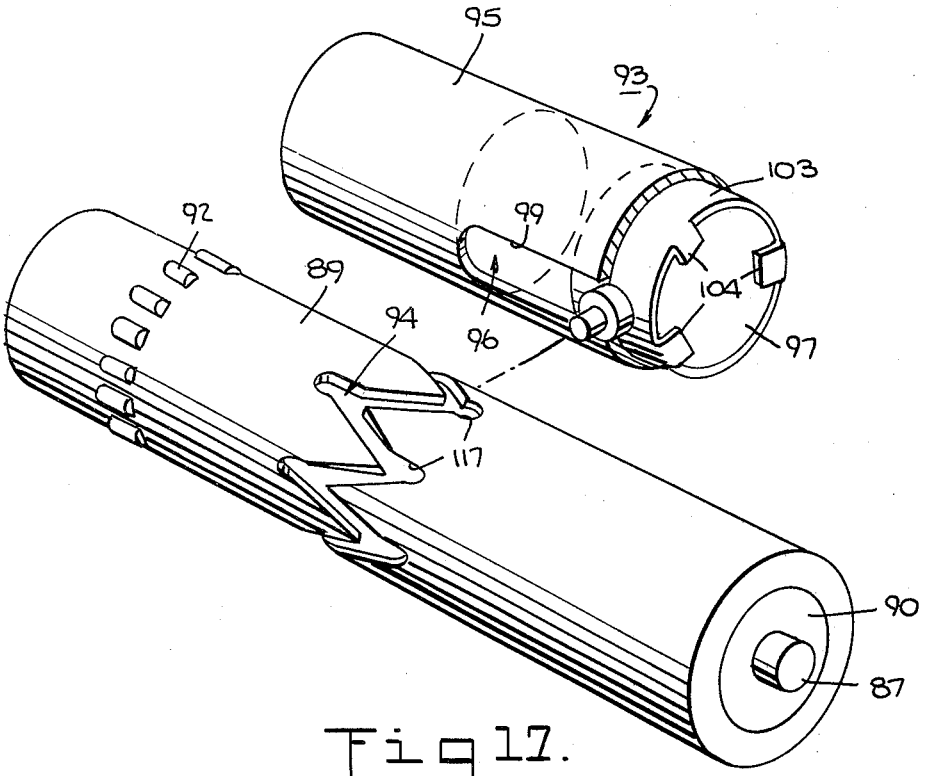
Fig 17.
Fig.16.
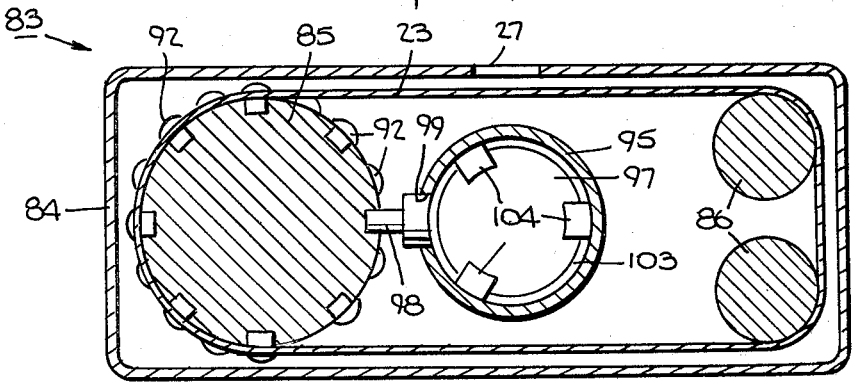

WATCH FOR DISPLAYING MULTIPLE WORLD TIMES

This invention relates to a watch for displaying world time and more particularly to a watch for displaying multiple world times.

As is well known, with the increasing use of intercontinental world travel, particularly with supersonic transportation being available, and the various telecommunications systems around the world, the different areas of the world are coming closer together. As a result, there is a need to compute the exact time in the different areas of the world for people who are travelling or are interested in sending international communications. In order to satisfy this need, reliance is sometimes made on the use of multiple clocks, for example, in airline terminals, telegraph offices and the like, to show the various times around the world. This, however, is costly and each clock must be calibrated from time-to-time. In other instances, electronic devices are used to read out the time in various parts of the world. However, this latter approach is usually not convenient for personal use since electronic devices are generally voluminious, expensive and cumbersome and some times even impossible to be transported from place to place.

It has also been known from U.S. Pat. No. 2,417,695 to construct a clock in such a fashion with a motor, gears and drums to display multiple world times. However, such a clock is inconvenient to carry on the person or from place-to-place.

Other types of world timepiece clocks have also been known from U.S. Pat. Nos. 3,279,165; 3,232,038; 3,226,926; 3,918,251 and 3,834,153. However, these have generally been of cumbersome structures which are not readily carried on the person.

It has also been known from U.S. Pat. No. 3,702,056 to provide a watch with various gears and a disc to indicate the times at a remote location or time zones. However, in this case, the disc is generally in a fixed relation to the hands indicating the actual time via gears, thus travel from one time zone to another requires re-calibration of the relationship by interrupting the geared relationship between the hands and the disc. This, of course, leads to wear if done repetitively over a period of time.

Because of the increasing mobility of people and the increasing use of international telecommunications, there is a need for a convenient, portable, and transportable world time device. However, the availability of different types of watches equipped with world times has been difficult. For example, in the case of mechanical watches, the knowledge of the time differential between cities and of mathematical computations is a prerequisite for such usage. In the case of electronic quartz watches, such have been relatively expensive due to the high cost of I.C. memories and quartz components. Further, the instructions for utilizing such watches are frequently very complex and are difficult to follow. Still further, such watches can only give the time of one city in each operation and, thus, are functionally limited to only a few cities of the world.

Accordingly, it is an object of this invention to provide a convenient, small, light, portable world time device to display world time anywhere in the world.

It is another object of the invention to provide a traveller and/or long distance caller with an easily available, small, easy to operate and durable world-time watch.

It is another object of the invention to provide a means by which any size watch may be transformed into a world time watch.

It is another object of the invention to provide a world time watch which can be produced at relatively low cost.

Briefly, the invention provides a watch which is capable of a simultaneous display of a multiplicity of times for various zones of the world. To this end, the watch has a component which includes an endless surface means on which a plurality of longitudinally disposed rows of incremental time designations are provided to define a plurality of transversely disposed sets of predetermined time designations, a casing of flat rectangular box shape to house the endless surface means with at least one window to expose a transverse row of time designations to view and a means for moving the endless surface means relative to the window in increments equal to a center-line to center-line spacing between adjacent transverse rows.

In one embodiment, the endless surface means is in the form of an endless belt while the means for moving the belt includes a rotatable cylinder over which the belt is disposed and a knob secured to the cylinder and exposed to the outside of the casing for rotating the cylinder. In this embodiment, a stop means is also provided for the cylinder in order to fix the position of the belt under the window of the casing. For example, the stop means may include a toothed gear on the cylinder in meshing engagement with the belt, a stationary support in the casing, a cam slidably mounted on the support for fitting between two adjacent teeth of the gear and a means, such as a spring for biasing the cam from the support to between two of the teeth to hold the gear and, thus, the cylinder in position.

In another embodiment, the endless surface means is in the form of a roller on which the incremental time designations are disposed. The means for moving this roller includes a knob which is secured to the roller and exposed to the outside of the casing for rotation of the roller. A stop means is also provided for holding the roller in the various incremental positions. To this end, the stop means is formed by a toothed gear which is formed on the roller and a spring strip secured to the casing with a free end biased into engagement with the gear between two adjacent teeth of the gear. This strip may be cut out from the casing to be integral with the casing or may be a separate element.

In another embodiment, the casing has a pair of parallel windows with indicia adjacent each window to designate predetermined locations in different world time zones. In this way, the number of items which can be displayed can be multiplied. Additional windows can be also used or can be made wider with a corresponding increase in the number of indicia on the endless surface means.

The watch is also provided with a read out means, such as a digital or conventional analog (i.e. hand dial) read out, for indicating the actual time in hours, minutes and seconds.

The watch component may also be incorporated into a console constructed with a display board having a map divided into time zones with each time zone being coincident with a respective one of the longitudinal rows of time designations.

The watch can be constructed to be manually actuated or automatically actuated.

In still another embodiment, the endless surface means is in the form of an endless belt while the moving means is electronically operated. In this case, the moving or control means includes a main cylinder over which the belt is disposed, a cog wheel on the cylinder in meshing engagement with the belt and an electromagnetic rotator assembly for rotating the cylinder in increments. The cylinder is provided with annular grooves of zig-zag shape while the rotator assembly includes a housing, a pair of electro-magnets disposed in the housing in spaced relation to each other, a permanent magnet disposed between the electro-magnets for reciprocating between two spaced terminal positions in response to selective activation of the electro-magnets and a driving pin which is mounted on the permanent magnet and projects into the groove of the cylinder. Upon activation of the respective electro-magnet, the permanent magnet moves from one terminal position to the other terminal position and causes rotation of the cylinder via the driving pin. The cylinder, in turn, advances the belt one increment to display a different row of time designations. The activation of the electro-magnets occurs hourly so that the cylinder may be moved one increment per hour to display the next set of time designations. The electro-magnets can be actuated by a driving circuit which includes a polarity changing device for changing the direction of electric current flow from the device to the electromagnets every hour automatically.

A watch constructed in the above manner may be in the form of a digital quartz watch or an analog quartz watch.

These and other objects and advantages of the invention will become more apparent from the following detailed description taken in conjunction with the accompanying drawings wherein:

FIG. 6 illustrates a view taken on line 6—6 of FIG. 4;

FIG. 7 illustrates a view taken on line 7—7 of FIG. 4;

FIG. 8 illustrates a view taken on line 8—8 of FIG. 4;

FIG. 15 illustrates an electro-magnetic watch constructed in accordance with the invention;

FIG. 16 illustrates a side view of a component of the watch of FIG. 15; and

FIG. 17 illustrates the components of a rotator assembly for rotating a cylinder of the watch of FIG. 15.

FIG. 18 illustrates an analog quartz watch in accordance with the invention.

Figure 1:
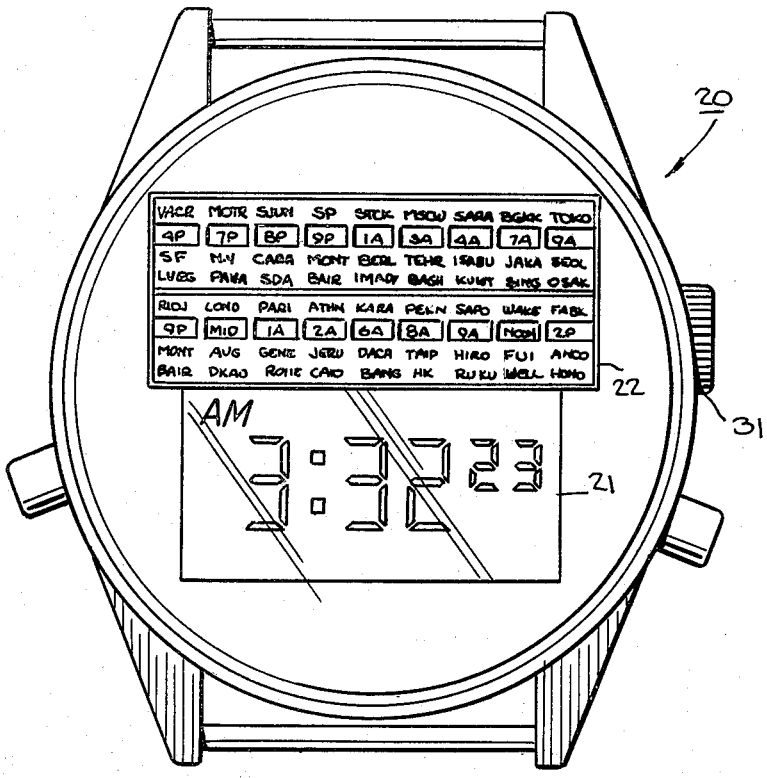
FIG. 1 illustrates a digital watch for displaying multiple world times constructed in accordance with the invention.

Referring to FIG. 1, the wrist watch 20 is of a digital type having a face 18 in which a digital read-out means 21 is disposed for indicating actual time in hours, minutes, and seconds. In addition, the watch 20 which is carried on a wrist band 19 has a component 22 for displaying multiple world times. This component 22 is adapted to illustrate the hour of various locations around the world coincident to the actual time displayed on the read-out means 21.

Figure 4:
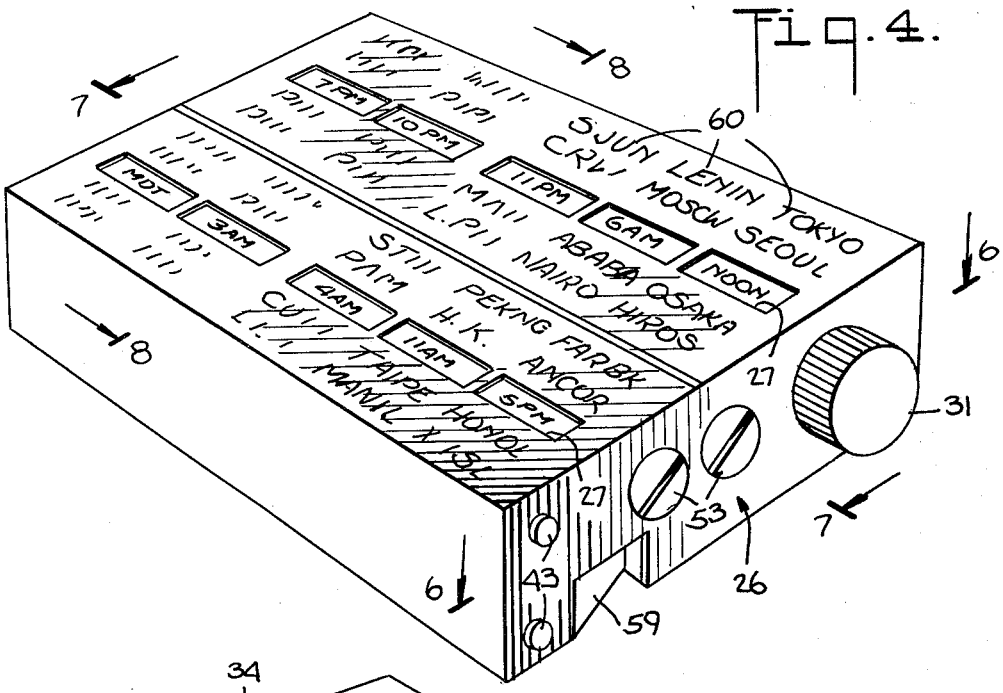
FIG. 4 illustrates a watch component for displaying multiple times in accordance with the invention.
Figure 5:
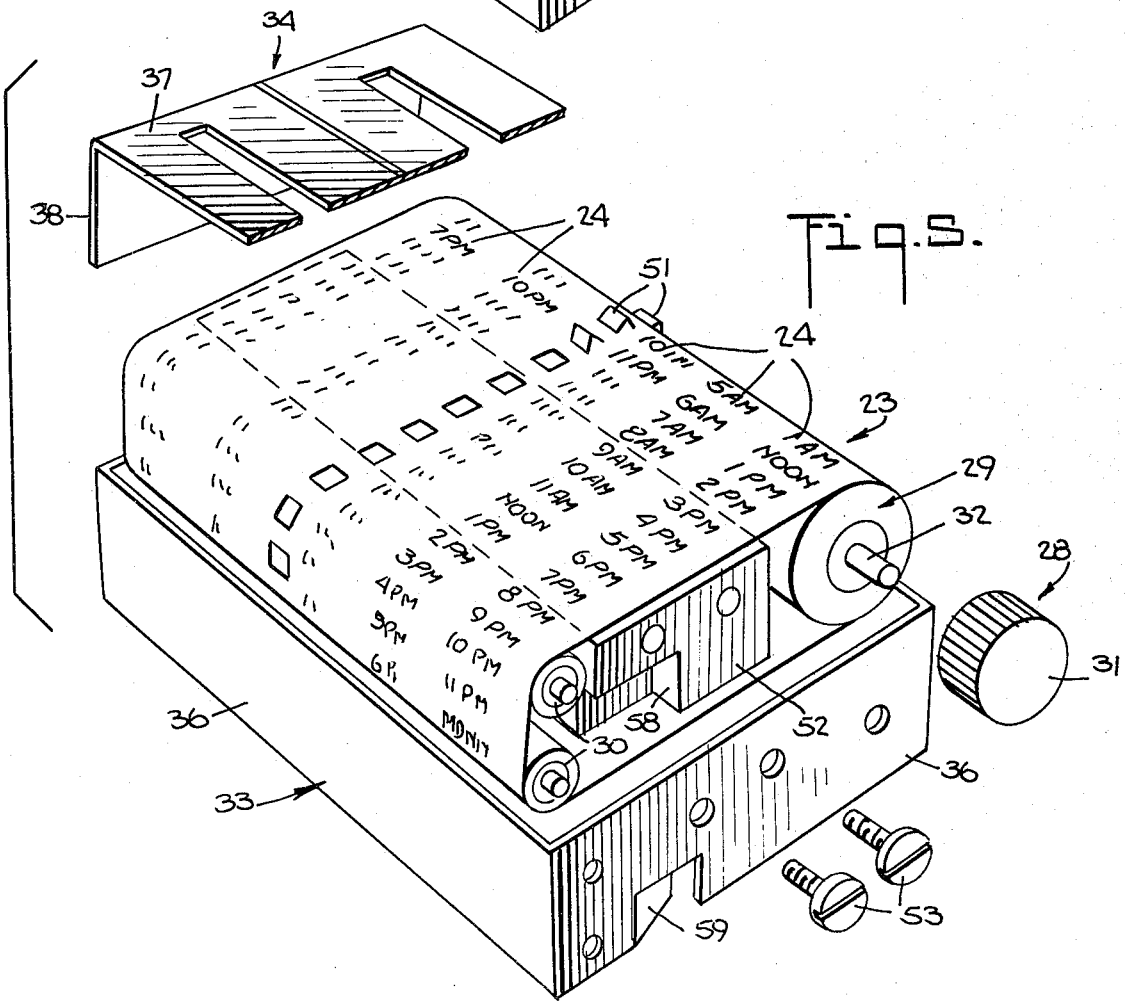
FIG. 5 illustrates an exploded view of the component of FIG. 4.

Referring to FIGS. 4 and 5, the component for displaying the world times includes an endless surface means 23 in the form of an endless belt which is provided with a plurality of longitudinally disposed rows 24 of incremental time designations 25. These rows 24 also define a plurality of transversely disposed sets of predetermined time designations 25. The component 22 also has a casing 26 which houses the endless belt 23 and which has a pair of windows 27 to expose a transverse row of the time designations 25 to view. In addition, the component has a means 28 for moving the belt 23 relative to the windows 27 in increments equal to a center-line to center-line spacing between the adjacent transverse rows of time designations 25. This moving means includes a rotatable main cylinder 29, a pair of guide rollers 30 about which the belt 23 is disposed and a knob 31 which is disposed outside the casing 26 and secured to the cylinder 29 via a shaft 32 for rotating the cylinder 29.

As indicated in FIGS. 6 and 7, the casing 26 has a flat rectangular box shape and is made of two components 33, 34 which fit into each other. The lower component 33 has a flat base 35 and four upstanding walls 36 while the top component 34 has a flat top 37 and two depending side walls 38.

As shown in FIG. 6, the main cylinder 29 has a cylindrical body 39 with a hollow bore 40 in which a tubular sleeve 41 is fixedly mounted. In addition, a pair of trunnions 42 are located at the ends of the sleeve 41 and have suitable axles 43 by which the trunnions 42 are journalled in the sidewalls 36, 38 of the casing 36. As shown in FIG. 6, one axle also serves as the shaft 32 of the knob 31. In addition, a tension spring 44 is located within the sleeve 41 between the trunnions 42 to bias the trunnions outwardly of each other. It is to be noted that the fit between the trunnions 42, sleeve 41 and body 39 is sufficient to permit rotation of the roller 29 via a turning of the knob 31.

Each roller 30 is constructed of a hollow tubular sleeve 45, a pair of trunnions 46 which are mounted at the ends of the sleeve 45 and carry axles 47 which are journalled in the walls 36, 38 and a tension spring 48 which is located within the sleeve 45 between the trunnions 46 to bias the trunnions 46 outwardly of each other. Again, the fit between the trunnions 46 and the sleeve 45 is sufficient to permit rotation of the roller 30 under the influence of the belt 23.

It is to be noted that the ends of the rollers 29, 30 are maintained in tension by the springs 44, 48 to facilitate the assembly of the rollers with the casing 26.

As shown in FIG. 6, the watch component also includes a stop means 49 for the roller 29. This stop means 49 includes a toothed gear 50 which is integrally formed on the cylinder 29 and disposed in meshing engagement with the belt 23 via suitable openings 51 in the belt 23. The stop means also has a stationary support or block 52 fixedly mounted within the casing 26 via pairs of screws 53, a cam 54 slidably mounted in the support 52 and a means in the form of a spring 55 biasing the cam 54 from the support 52 to between two gear teeth. The spring 55 is disposed in a recess 56 of the block 52 about a stem 57 of the cam 54 for stability purposes. As shown in FIG. 8, the cam 54 has a conically shaped surface for fitting between the teeth of the gear 50.

The block 52 has a pair of recesses 58 on opposite sides while the casing walls 36 are provided with cut-out plates 59 which are received in the recesses 58. The screws 53 serve to prevent forward and backward movements of the support 52 while the cut-outs 59 prevent ascending or decending movements.

The teeth of the gear 50 are constructed of a smooth streamline shape to facilitate movement of the gear 50 in relation to the cam 54. This will allow the turning of the knob 31 to be an effortless task.

Referring to FIG. 4, the surface of the casing 26 is provided with indicia 60 adjacent each window 27 in order to designate predetermined locations in different world time zones. These indicia 60 are keyed to each other and to the designations 25 on the belt 23 so as to indicate various cities in the respective times zones.

Figure 2:
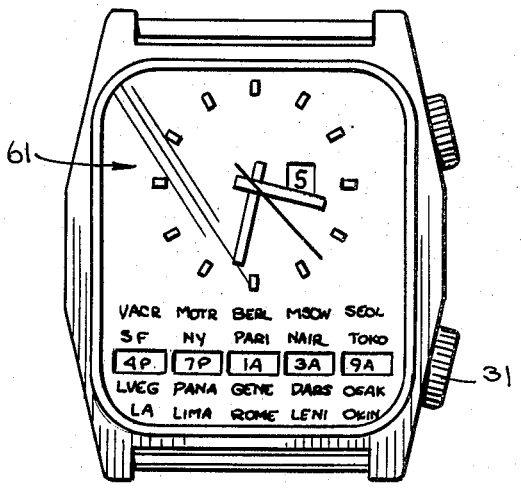
FIG. 2 illustrates a conventional hand-dial wrist watch for displaying world time in accordance with the invention.

Referring to FIG. 4, the indicia 60 are printed, for example with dimensions of 0.80 millimeters or larger and in different colors to provide for an ease of reading and recognition. In addition, the indicia for A.M. times are made of a different color or shade than the P.M. times indicia so as to further indicate the time of day at a remote location of the world as well as a difference in days. For this purpose, as shown in FIG. 2, the component 22 is provided with a designation of the International Date Line (IDL).

The rows of time designations 25 on the belt 23 are disposed in 24 hour time cycles, i.e. 24 transverse rows and from, for example, 5 to 24 longitudinal rows across the belt depending upon the number of regions or time zones to be covered. For example, 5 time zones are illustrated in FIG. 4 and the time difference between the two windows 27 is a five hour difference.

The position of the driving gear 50 is determined by the stop means 49 via the cam 54. Therefore, the belt 23 is so gauged that after each twist of the knob 31, the desired time position will be visible through the windows 27. Thus, upon turning of the knob 31, the belt 23 is driven by the meshing of the gear 50 and the holes 51 in the belt 23. Each increment of motion of the belt moves the belt 23 exactly one hour increase or decrease.

In order to use the watch, the correct time is first set on the read-out means 21. Thereafter, the knob 31 is turned to align the belt 23 to display the correct time for a known city at another point in the world in the appropriate position under a window 27. For example, if the read-out means 21 displays a time of 3:32 A.M. and the correct time in New York is 7:32 P.M., the knob 31 is turned until the designation "7P" appears in the window 27 under the designation NY. This simultaneously indicates the correct times in the other cities indicated on the timepiece. Subsequently, as the read-out 21 changes time to 4:00 A.M., the knob 31 is turned one increment either manually or automatically as described below.

Figure 3:
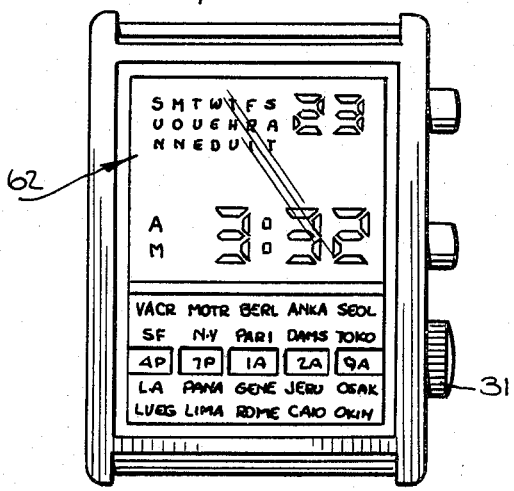
FIG. 3 illustrates a digital calendar watch for displaying world times in accordance with the invention.

The watch may also be constructed with a hand dial read-out as shown in FIG. 2 as well as in the form of a calendar watch with a day read-out 62 as shown in FIG. 3.

Figures 9, 10, 11:
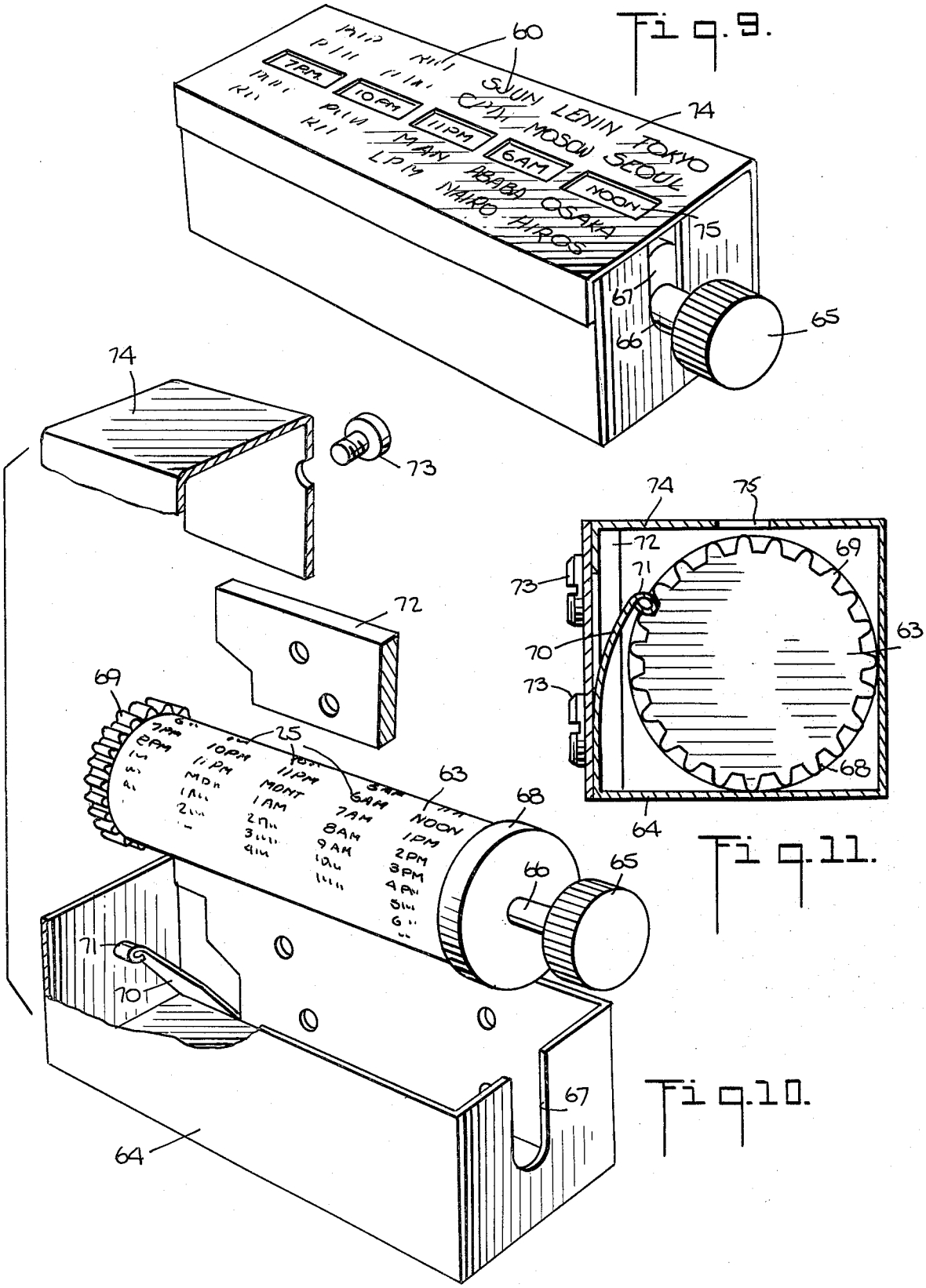
FIG. 9 illustrates a modified component for displaying world times in a watch in accordance with the invention.
FIG. 10 illustrates a partial exploded view of the component of FIG. 9.
FIG.11 illustrates an end view of the component of FIG. 9.

Referring to FIGS. 9 to 11, the component for reading out world times may alternatively be constructed with an endless surface means in the form of a roller 63 on the surface of which the various time designations 25 are located in longitudinal and transverse rows. In this case, the casing 64 for housing the roller 63 is of generally box shape. In this embodiment, the roller 63 is provided with a means in the form of a knob 65 for rotating the cylinder 63 within the casing 64. As shown in FIG. 10, the knob 65 is fixed to the roller 63 via a shaft 66 which is journalled within a cut-out 67 in the wall of the casing 64. In addition, the roller 63 has an enlarged collar 68 at the end adjacent to the knob 65 which rests on the floor of the casing 64 for smooth rotation thereon. The roller 63 also has a stop means in the form of a toothed gear 69 at the opposite end of the roller 63 and a spring strip 70 which is cut out from a side wall of the casing 64 in an integral manner. This strip 70 has a free end 71 which is biased into engagement with the gear 69 between two adjacent teeth thereon (see FIG. 11).

The collar 68 is of a diameter to prevent the main surface of the cylinder 63 from rubbing on the surfaces of the casing 64 while the gear 69 serves to support the roller 63 on the casing bottom and the spring strip 70 serves to stabilize the roller 63.

Referring to FIG. 10, the lower part of the spring strip 70 is broader than the upper part to increase the durability of the strip 70. The surface of the rounded end 71 and the teeth of the gears 69 are made smooth and in streamline fashion in order to increase the ease of which the strip 70 may be able to slide when the gear 69 moves either forwards or backwards.

The casing 64 also has a metal plate 72 mounted on the wall from which the spring strip 70 is cut out in order to reinforce the wall. This plate 72 is secured to the casing wall via bolts 73 as shown in FIG. 11.

Referring to FIG. 9, the top surface of the casing 64 is provided with a window 75 through which the indicia 25 on the roller 63 can be viewed.

The operation of the component is similar as to that as described above with respect to FIGS. 1 to 8.

Figure 12:
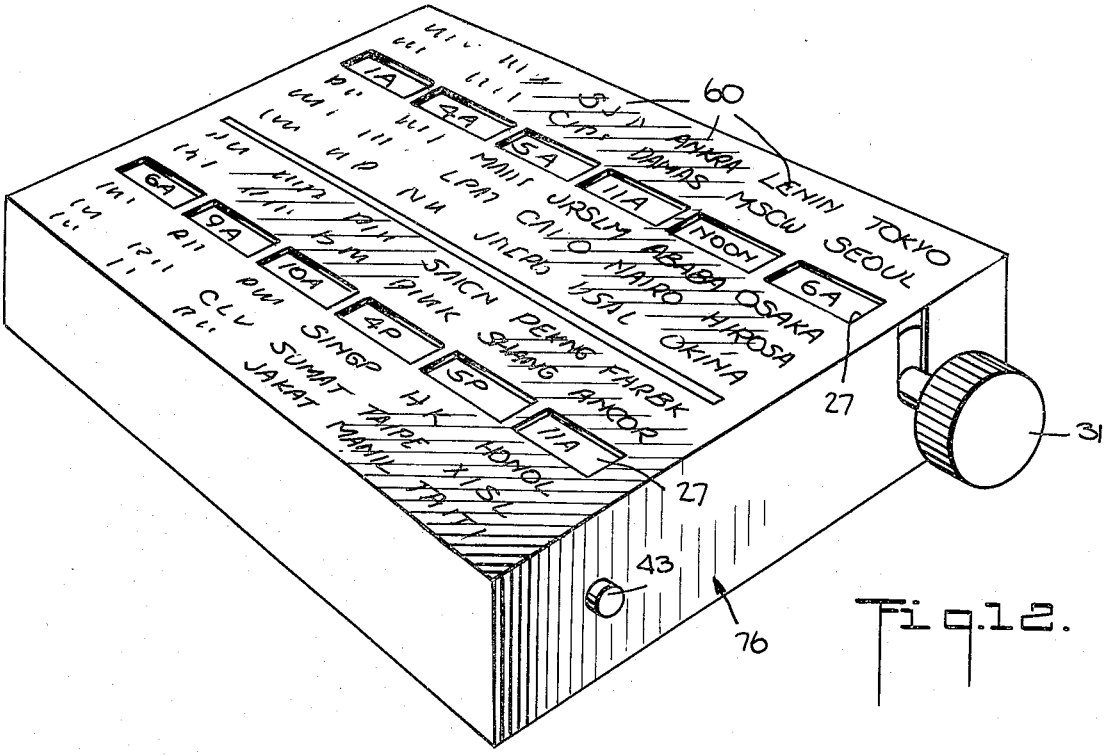
FIG. 12 illustrates a further modified component for displaying world time constructed in accordance with the invention.
Figure 13:
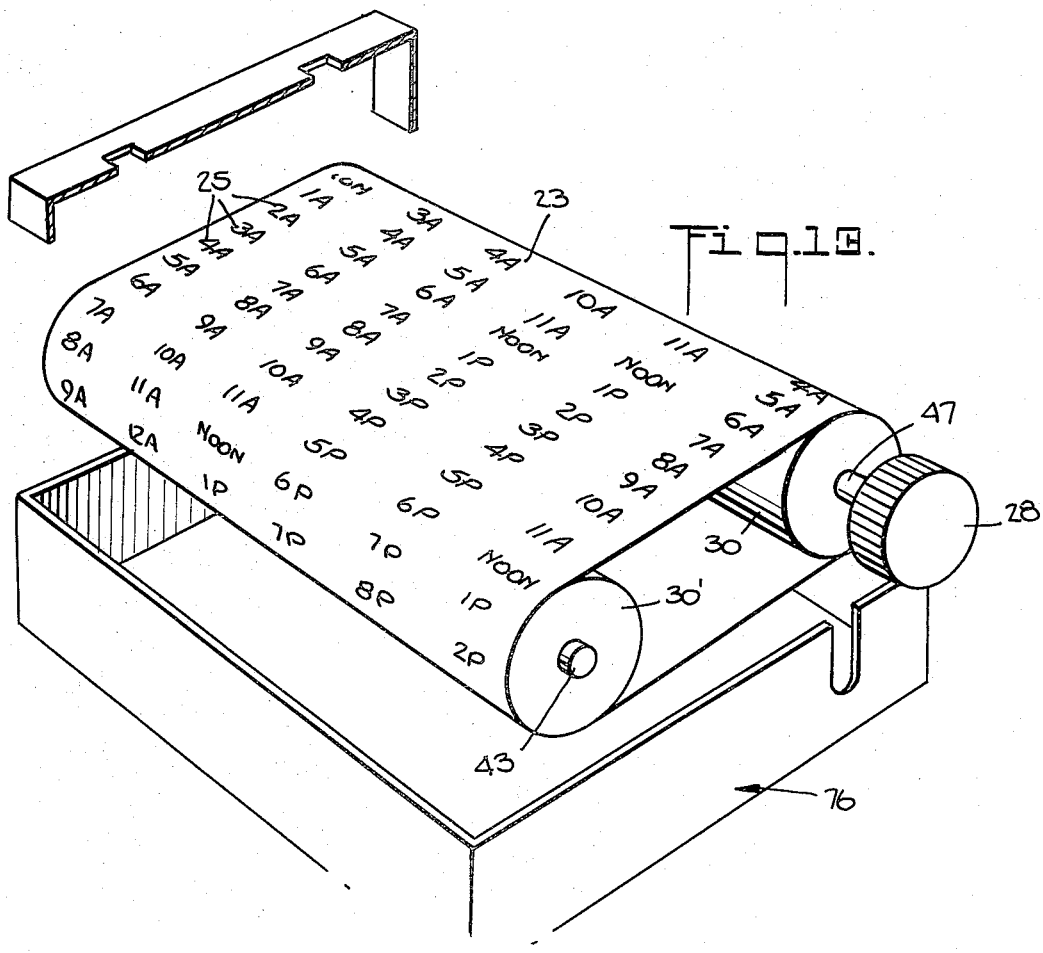
FIG. 13 illustrates an exploded view of the component of FIG. 12.

Referring to FIGS. 12 and 13, wherein like reference characters indicate like parts as above the watch can be provided with a component for displaying the world times of a further simplified construction. To this end, the casing of the display component 76 is of flat rectangular shape.

As shown, an endless belt 23 is provided with the various indicia 25 and is disposed about two rollers 30, 30'. Each roller 30, 30' is constructed in the manner of the rollers described with respect to FIG. 6 and one is provided with an extended axle 47 on which a knob 31 is mounted in the casing 76 in similar manner to that as described above and the casing 76 is made of like construction as the casing 26. In this case, a stop means is not used but reliance is made upon the friction between the rollers 30, 30' and casing 76 to hold the belt 23 in position.

Figure 14:
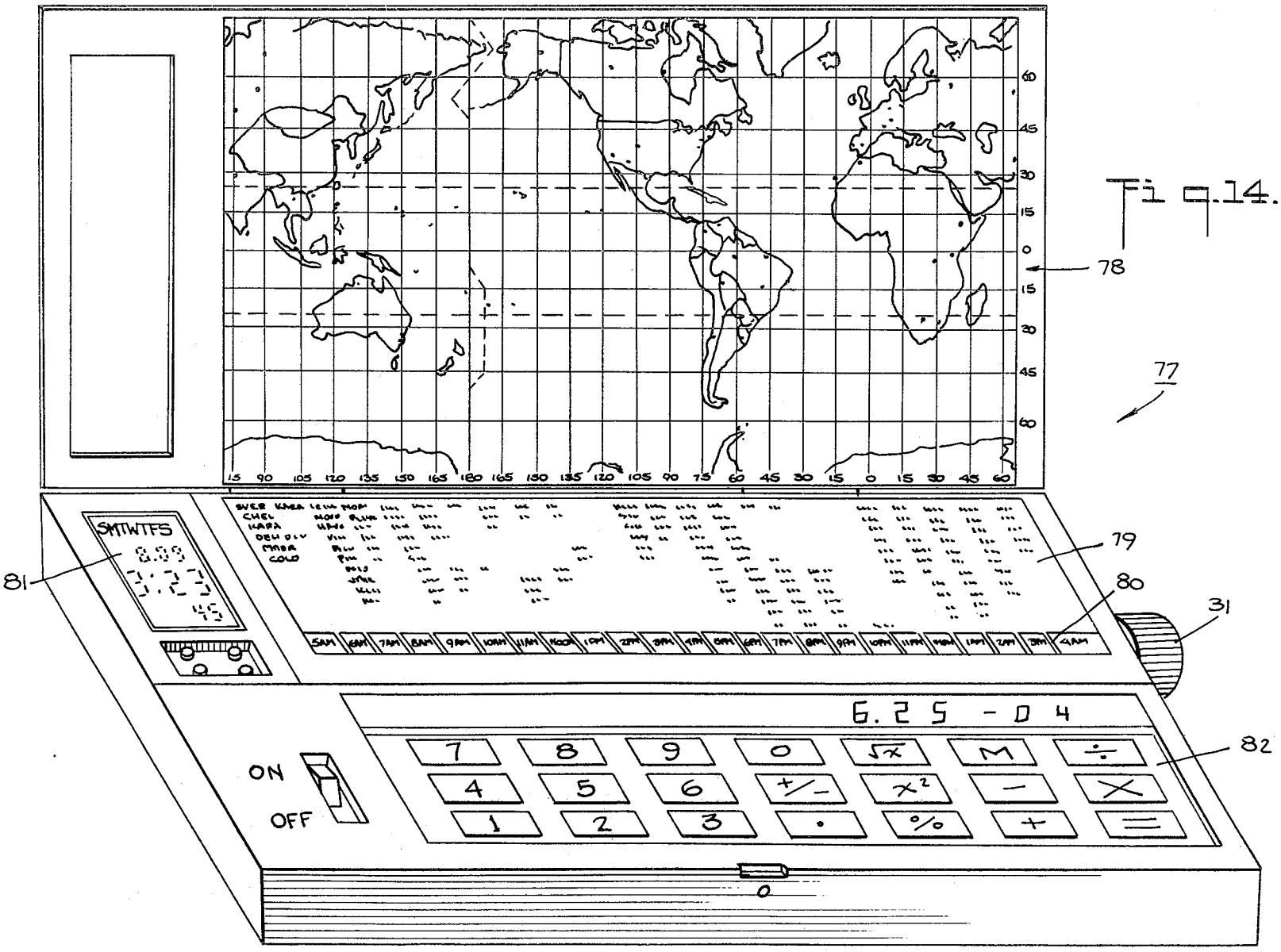
FIG. 14 illustrates a perspective view of a timepiece employing a display board with a map constructed in accordance with the invention.

Referring to FIG. 14, the component can be incorporated into a pocket console unit 77 which contains a map display 78, a board display 79 indicating various cities within each time zone displayed on the map 78 and a window 80 for reading out the times in the various time zones. A knob 28 is issued to rotate the endless surface means for displaying the various indicia 25 in a manner similar to that described above. In this case, the endless surface means may be in the form of a belt as described in FIG. 4 or in the form of a roller as described in FIG. 10.

The console 77 may also be provided with a digital read-out 81 for displaying the time and date as well as with a calculator 82 for carrying out various mathematical computations. The map display 78 can be hinged to the console 77 to be closed down over the calculator 82 when not in use.

The names of the cities arranged on the display 79 are positioned to provide easy access to locating the time of cities of interest. This console provides a traveller by air or sea with a rapid means of locating any location of the world and the time thereat.

Referring to FIGS. 15 to 17, the watch may also be constructed as an automatic watch so that the world times are automatically incremented. To this end, the world time component 83 includes a casing 84 of flat rectangular shape in which a main cylinder 85 and a pair of guide rollers 86 are journalled via suitable axles 87, 88 in the side walls of the casing 84. The main cylinder 85 is constructed of a tubular sleeve 89 (FIG. 15) in which a pair of trunnions 90 are mounted and biased apart by means of a tension spring 91. The fit between the trunnions 90 and the sleeve 89 is such as to permit rotation of the sleeve 89. The roller 85 also has a cog wheel 92 on the outer periphery which serves to mesh with an endless belt 23 in a manner similar to the above.

Each roller 86 is constructed in similar manner to the rollers 30 above and need not be further described. In addition the casing 84 is provided with a window 27 as described above while the endless belt 23 is provided with various time designations as described above.

The moving means for moving the belt 23 is composed of a main cylinder 85, a cog wheel 92 on the cylinder which is disposed in meshing engagement with the belt 23 and an electromagnetic rotator assembly 93 which rotates the cylinder 85 in increments, i.e. hourly increments.

As shown in FIG. 17, the cylinder 85 is provided with an annular groove 94 of zig-zag shape. The rotator assembly 93 includes a cylindrical housing 95 which is mounted within the casing 84 (see FIG. 15). In addition, the rotator assembly has a pair of electro-magnets 96 which are mounted at opposite ends of the housing 95 in spaced relation to each other to define a chamber, and a permanent magnet 97 which is disposed between the electro-magnets 96 for reciprocating between two spaced terminal positions within the chamber in response to selective activation of the electro-magnets 96. In addition, the permanent magnet 97 carries a driving pin 98 which is made of sapphire or carbide and projects through a guide slot 99 which extends along the housing 95 into the groove 94 in the cylinder 85. Each electro-magnet 96 includes a soft iron core 100 which is disposed within the housing 95 and fixed to the casing 84 via a threaded scre 101 and a winding of coils 102 about each soft iron core 100.

The soft iron cores 100 are converted into electro-magnets when electric currents flow through the coils 102. To this end, the coils 102 are installed to allow the electric current to flow in opposite directions. When this occurs, the electro-magnets 96 assume the same poles facing each other so that one pushes while the other pulls the permanent magnet 97 so as to move the permanent magnet 97 to one side or the other.

The permanent magnet 97 is protected by a stainless steel case 103 and the driving pin 98 is welded or otherwise secured to this case 103. Suitable tabs 104 are disposed over the ends of the case 103 to minimize the impacts of the permanent magnet 97 against the electro magnets 96.

Referring to FIG. 17, the shape of the groove 94 is such that the driving pin 98 cannot return to the same track but must move along in a new track thus turning the cylinder 85 in only one direction. The zig-zag tracks of the groove 94 are similar to the teeth of a gear.

As shown in FIG. 15, a case cap 105 is provided at one end close over the guide slot 99 while the opposite end is provided with a stop 106 which is in the form of a tap 106 extending into a slot in the casing 84.

As shown in FIG. 15, the watch is provided with a driving circuit 107 for activating the electro-magnets 86 each hour. This circuit 107 can be an ordinary quartz electronic circuit wherein current flows from a suitable energy source 108, for example a battery, through an oscillator 109 to a divider 110 to effect a display of seconds, minutes, and hours on a digital display 111. In addition a manual switch control 112 is provided in the circuit to selectively deliver power through a buffer 113 and a driving circuit 114 to the electro-magnets 96 via lines 115, 116. The manual switch control 112 can be activated, for example by a push button. The driving circuit 114 contains a polarity changing device which is connected via the lines 115, 116 to the coils 102 of the electro-magnets 96, such that when the switch control 112 is activated, electric current passes to the coils 102 in one direction and is then programmed to flow in the reverse direction when the switch control 112 is activated the next time.

The rotator assembly is capable of transferring motion directly even in a small space of, for example 0.50 millimeters. Moreover, the assembly eliminates the need for using multiple gears for changing speeds and transfering power.

When no electric current flows through the coils 102, the permanent magnet 97 and the adjacent soft iron coil 100 pull each other so that the driving pin 98 stops and remains at a half circle corner 117 of the annular groove 94. Thus, the cylinder 85 cannot rotate. Consequently, the time indicia on the belt 23 remains steady and can be controlled to appear in the center of the window 27.

The buffer 113 and polarity changing device in the driving circuit 114 allow the direction of the electric current to be changed every hour automatically. It is to be noted that the activation of the polarity changing device need only occur each hour. At other times, no current is directed to the coils 102 of the electro-magnets 96.

In order to modify the digital quartz watch to operate as a world timepiece, it is only necessary to install a manual control switch 112, a buffer 113 and a driving circuit 114 with a polarity changing device between the world timer and digital watch. In the case of an annalog quartz watch, another device called a divider must be installed to convert the watch into an automatic world timepiece.

FIG. 18 illustrates a circuit 118 for an annalog quartz watch wherein like reference characters indicate like parts as above. In this circuit 118, electric current flows through an oscillator 109 to a divider 110 and then to another divider 119 which enables current to flow once every hour. Power is transmitted from the oscillator 109 to suitable gears 120 to move second, minute, and hour hands 121 while a suitable crown 122 is used to adjust the read-out of the watch.

In the case of mechanical, electric or quartz annalog watches, one may convert a watch by connecting the main cylinder of the world timer component directly to the cog wheel of the watch (not shown).

It is to be noted that the various windows of the watches may be formed of convex glass in order to enlarge the indicia of the time designations. Also, the time figures may be printed in two different colors to distinguish between A.M. and P.M.

The invention thus provides a watch which can be used automatically to display various times in various cities through the world simultaneously. The watch is of compact construction and can be easily used with a suitable wrist band as a wrist watch or with suitable chains or cases for use as a pocket watch, and the like.

What is claimed is:

1. A watch for displaying multiple world times, said watch comprising a face having a read-out means for indicating actual time in hours, minutes and seconds;

an endless belt having a plurality of longitudinally disposed rows of incremental time designations thereon, said rows defining a plurality of transversely disposed sets of predetermined time designations;

a casing of flat rectangular box shape housing said endless belts therein and having at least one window to expose a transverse row of said time designations to view in said face; and means for moving said endless belts relative to said window in increments equal to a center-line to center-line spacing between adjacent transverse rows, said means including a main cylinder having an annular groove of zig-zag shape, a cog wheel on said cylinder in meshing engagement with said belt, and an electro-magnet rotator assembly for rotating said cylinder in increments, said rotator assembly including a housing, a pair of elector-magnets disposed in said housing in spaced relation to each other, a permanent magnet disposed between said electro-magnets for reciprocating between two spaced terminal positions in response to selective activation of said electro-magnets, and a driving pin mounted on said permanent magnet and projecting into said groove of said cylinder whereby upon activation of said electro-magnets, said permanent magnet moves from one terminal position to the other terminal position while rotating said cylinder.

2. A watch as set forth in claim 1 wherein said housing is tubular and is made of stainless steel.

3. A watch as set forth in claim 1 which further comprises a driving circuit for activating said electro-magnets, said circuit including a polarity changing device for changing the direction of electric current flow from said device to said electro-magnets every hour automatically.

4. A watch as set forth in claim 3 wherein said watch is a digital quartz watch.

5. A watch as set forth in claim 3 wherein said watch is an analog quartz watch.

6. An electro-magnet rotator assembly for rotating a cylinder in increments, wherein said cylinder has an annular groove with a zig-zag shape;

said rotator assembly including a housing, a pair of electro-magnets disposed in said housing in spaced relation to each other, a permanent magnet disposed between said electromagnets for reciprocating between two spaced terminal positions in response to selective activation of said electro-magnets, and a driving pin mounted on said permanent magnet and projecting into said groove of said cylinder whereby upon activation said electro-magnets, said permanent magnet moves from one terminal position to the other terminal position while rotating said cylinder.

7. An electro-magnetic rotator assembly as set forth in claim 6 which further comprises a driving circuit for activating said electro-magnets, said circuit including a polarity changing device for sequentially changing the direction of electric current flow from said device to said electro-magnets automatically.

* * * * *